US011053097B2

(12) United States Patent
Khzouz et al.

(10) Patent No.: US 11,053,097 B2
(45) Date of Patent: Jul. 6, 2021

(54) MAGNET ASSEMBLY FOR AN ELECTRONIC SAFETY BRAKE ACTUATOR (ESBA)

(71) Applicant: Otis Elevator Company, Farmington, CT (US)

(72) Inventors: Erik Khzouz, Plainville, CT (US); Justin Billard, Amston, CT (US); Daryl J. Marvin, Farmington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 277 days.

(21) Appl. No.: 16/046,199

(22) Filed: Jul. 26, 2018

(65) Prior Publication Data

US 2020/0031621 A1 Jan. 30, 2020

(51) Int. Cl.
*B66B 5/22* (2006.01)

(52) U.S. Cl.
CPC ..... *B66B 5/22* (2013.01)

(58) Field of Classification Search
CPC ..... B66B 5/22
See application file for complete search history.

(56) References Cited

U.S. PATENT DOCUMENTS 7,299,898 B2 * 11/2007 Husmann ..... B66B 5/20 187/373
9,688,512 B2 6/2017 West et al.
9,981,827 B2 5/2018 Osmanbasic et al.
10,309,475 B2 * 6/2019 Duvall ..... F16D 69/0408
10,584,014 B2 * 3/2020 Fauconnet ..... B66B 5/044
2013/0043097 A1 * 2/2013 Widmer ..... B66B 5/02 187/288
2014/0008157 A1 * 1/2014 Terry ..... B66B 5/22 187/359

(Continued)

FOREIGN PATENT DOCUMENTS

CN 106395544 A 2/2017
CN 107082338 A 8/2017

(Continued)

OTHER PUBLICATIONS

CN Office Action; Application No. 201910675770.9; dated Nov. 4, 2020; 7 pages.

*Primary Examiner* — Michael A Riegelman
(74) *Attorney, Agent, or Firm* — Cantor Colburn LLP

(57) ABSTRACT

Disclosed is an electronic safety brake actuator (ESBA) for actuating an electronic brake, the ESBA having: a first member having a proximate side and a distal side spaced in a widthwise direction, a first nominal front surface and a first rear surface spaced in a depth-wise direction, and a first top surface and a first bottom surface spaced in a height-wise direction, a plurality of side members including a proximate member and a distal member, the proximate member disposed adjacent the proximate side of the first member and the distal member disposed adjacent the distal side of the first member, the first member being magnetic and the plurality of side members being at least partially non-magnetic, and the plurality of side members including a respective plurality of nominal front surfaces including a proximate front surface and a distal front surface, the plurality of nominal front surfaces being co-planar.

6 Claims, 4 Drawing Sheets

(56) References Cited

U.S. PATENT DOCUMENTS

| | | | | |
|---|---|---|---|---|
| 2014/0224594 | A1* | 8/2014 | Billard | B66B 5/18 187/359 |
| 2015/0259175 | A1* | 9/2015 | West | F16D 63/008 187/359 |
| 2017/0001835 | A1* | 1/2017 | Hu | B66B 5/22 |
| 2017/0066627 | A1* | 3/2017 | Hu | B66B 5/18 |
| 2017/0107078 | A1* | 4/2017 | Hu | B66B 5/22 |
| 2017/0129741 | A1* | 5/2017 | Hu | B66B 5/22 |
| 2017/0217726 | A1 | 8/2017 | Guilani et al. | |
| 2017/0283216 | A1* | 10/2017 | Marvin | B66B 5/0031 |
| 2017/0283217 | A1* | 10/2017 | Marvin | B66B 5/0031 |
| 2018/0222718 | A1* | 8/2018 | Khzouz | B66B 5/18 |
| 2018/0327224 | A1* | 11/2018 | Billard | B66B 5/22 |
| 2019/0177124 | A1* | 6/2019 | Billard | B66B 7/047 |
| 2019/0186573 | A1* | 6/2019 | Manes | F16F 1/187 |
| 2019/0352127 | A1* | 11/2019 | Billard | B66B 5/044 |
| 2020/0031621 | A1* | 1/2020 | Khzouz | B66B 5/22 |

FOREIGN PATENT DOCUMENTS

| | | | |
|---|---|---|---|
| CN | 107416637 | A | 12/2017 |
| EP | 2837592 | A1 | 2/2015 |
| EP | 3153451 | A1 | 4/2017 |
| EP | 3281905 | A2 | 2/2018 |
| GB | 2241488 | A | 9/1991 |
| WO | 2012110273 | A1 | 8/2012 |
| WO | 2016078435 | A1 | 5/2016 |
| WO | 2017087978 | A1 | 5/2017 |

* cited by examiner

MAGNET ASSEMBLY FOR AN ELECTRONIC SAFETY BRAKE ACTUATOR (ESBA)

BACKGROUND

Exemplary embodiments pertain to the art of electronic safety brake actuators (ESBA) for actuating electronic safety brakes (ESB) and more specifically to a magnet assembly in the ESA.

An elevator car may include an ESB for use during over-speed or free fall conditions to decelerate the elevator car. The ESB may use at least one structural wedge to apply emergency stopping forces normal to an elevator rail. The normal forces may be translated to frictional forces between the wedge and the elevator rail, which may decelerate the elevator car.

The ESA may use a magnet assembly to generate normal forces against the rail, and a linkage assembly may transfer the generated energy to the ESB to lift the wedge against the elevator rail for decelerating the elevator car. Design and manufacturing limitations for the magnet assembly in the ESA may limit the mass of the wedge used in the ESB and the speed at which the wedge in the ESB lifts against the elevator rail. For example air gaps in the magnet assembly in the ESA from manufacturing variation may reduce the generated normal force by the ESA against the elevator rail.

BRIEF DESCRIPTION

Disclosed is an electronic safety brake actuator (ESBA) for actuating an electronic brake, the ESBA comprising: a first member having a proximate side and a distal side spaced in a widthwise direction, a first nominal front surface and a first rear surface spaced in a depth-wise direction, and a first top surface and a first bottom surface spaced in a height-wise direction, a plurality of side members including a proximate member and a distal member, the proximate member disposed adjacent the proximate side of the first member and the distal member disposed adjacent the distal side of the first member, the first member being magnetic and the plurality of side members being at least partially non-magnetic, and the plurality of side members including a respective plurality of nominal front surfaces including a proximate front surface and a distal front surface, the plurality of nominal front surfaces being co-planar.

In addition to one or more of the above disclosed features or as an alternate the ESBA comprises a friction feature extending forwardly in the depth-wise direction from at least one of: the plurality of nominal front surfaces of the plurality of side members, and the first nominal front surface of the first member, wherein the friction feature comprises a plurality of teeth forming a saw-tooth profile.

In addition to one or more of the above disclosed features or as an alternate the plurality of side members extend rearwardly in the depth-wise direction beyond the first member.

In addition to one or more of the above disclosed features or as an alternate the first member and the plurality of side members are metal.

In addition to one or more of the above disclosed features or as an alternate the plurality of nominal front surfaces of the respective plurality of side members are co-planar with the first nominal front surface.

In addition to one or more of the above disclosed features or as an alternate the plurality of side members and the first member have a same span in the height-wise direction.

In addition to one or more of the above disclosed features or as an alternate the plurality of side members and the first member are fixedly connected by at least one connector extending in the widthwise direction through the ESBA.

In addition to one or more of the above disclosed features or as an alternate the ESBA comprises a cover plate connected to the front surface of the first member, the cover plate having a same span in the width-wise direction as the first member, the cover plate including the friction feature.

In addition to one or more of the above disclosed features or as an alternate the cover plate is non-magnetic metal.

In addition to one or more of the above disclosed features or as an alternate the plurality of side members are widthwise integrally connected to form a unitary housing, the housing including: a top portion forming a top bracket extending adjacent the first top surface of the first member and the front surface of the first member, a bottom portion forming a bottom bracket extending adjacent the first bottom surface of the first member and the front surface of the first member, and wherein the housing comprises an opening through which the housing slidingly receives the first member.

Further disclosed is a method of manufacturing an electronic safety brake actuator (ESBA) for actuating an electronic brake, the method comprising one or more of the above disclosed features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
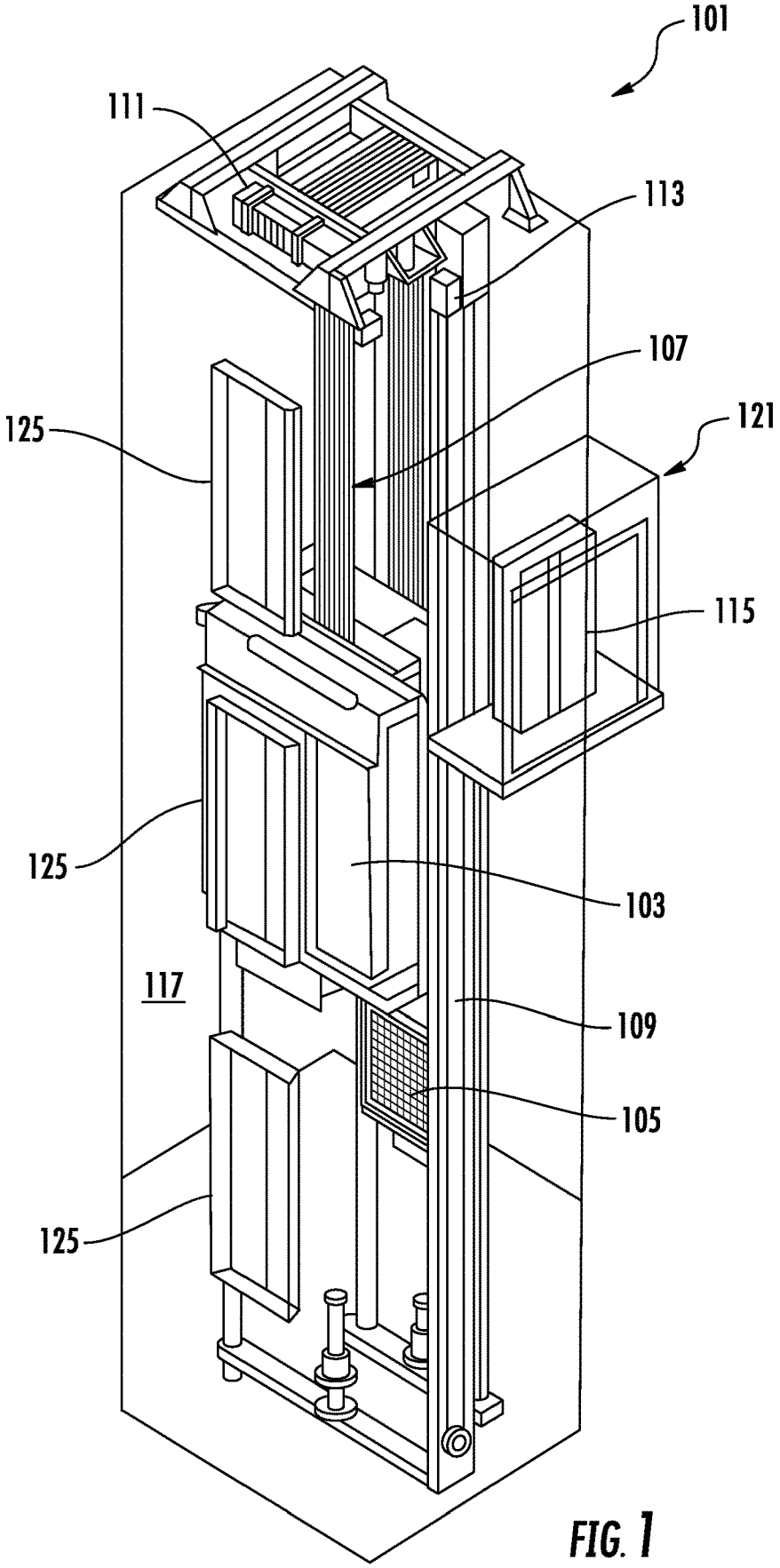
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101.

The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Features and elements disclosed in FIGS. 2-6 having nomenclature that is the same or similar to that in FIG. 1 may be similarly construed even though numerical identifiers may differ.

Figure 2A:
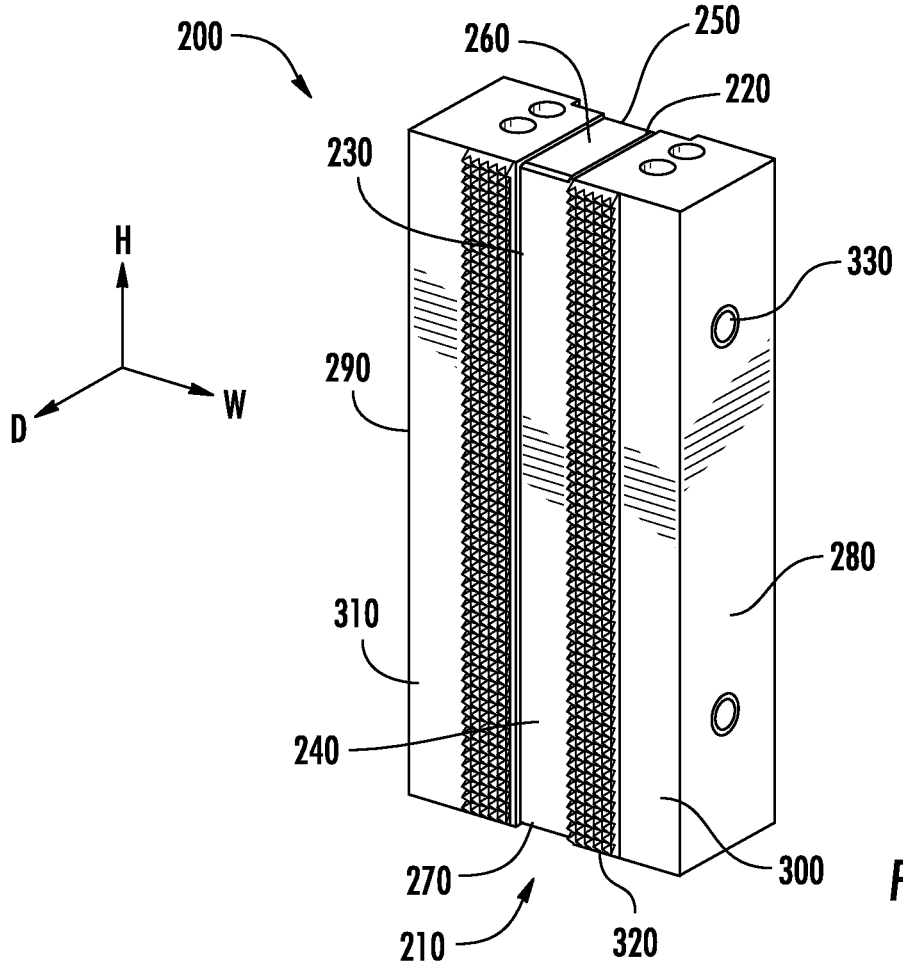
FIGS. 2A and 2B illustrate an electronic safety brake actuator (ESBA) according to a disclosed embodiment.
Figure 2B:
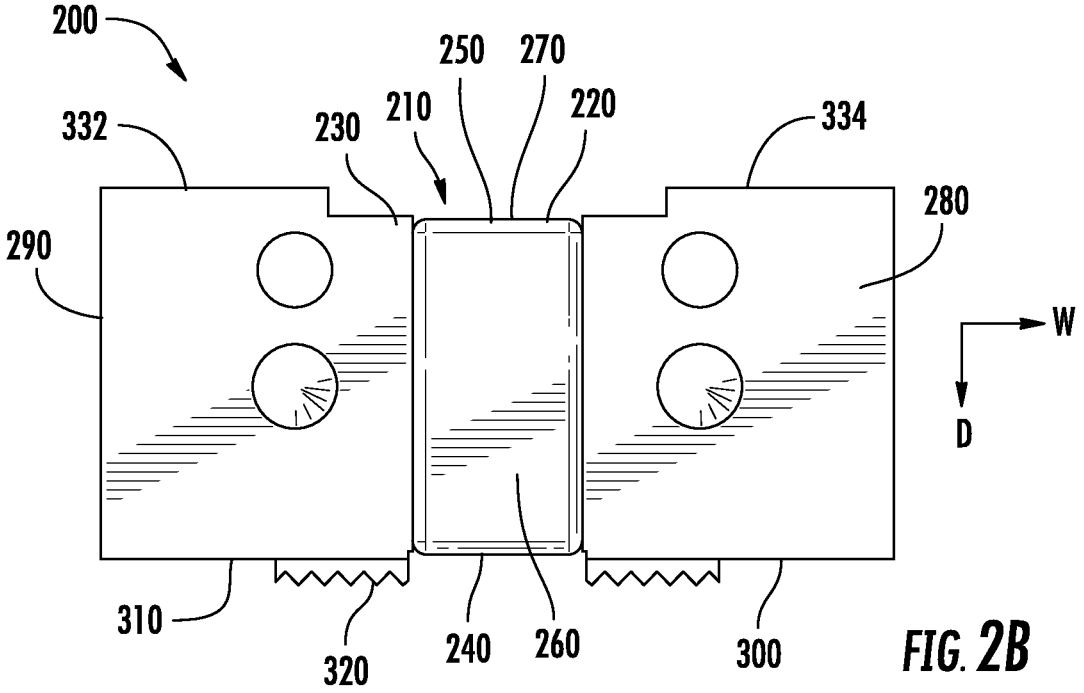

Turning to FIGS. 2A and 2B, disclosed is an electronic safety brake actuator (ESBA) 200. The ESBA 200 may include a first member 210 which is a center member that is centered in a widthwise direction W within the ESBA 200. The center member 210 may have a proximate side 220 and a distal side 230 spaced in the widthwise direction W. The center member 210 may have a first nominal front surface 240 and a first rear surface 250 spaced in a depth-wise direction D. In addition, the center member 210 may have a first top surface 260 and a first bottom surface 270 spaced in a height-wise direction H.

The ESBA 200 may include a plurality of side members. The plurality of side members may include a proximate member 280 and a distal member 290. The proximate member 280 of the ESBA 200 may be disposed adjacent or against the proximate side 220 of the center member 210. The distal member 290 of the ESBA 200 may be disposed adjacent or against the distal side 230 of the center member 210.

According to an embodiment, the center member 210 may be magnetic and the plurality of side members may be metal or a non-metal, and may also be magnetic or non-magnetic. According to an embodiment the center member 210 and the plurality of side members may be metal, such as steel.

The plurality of side members may include a respective plurality of nominal front surfaces. The plurality of nominal front surfaces may respectively include a proximate front surface 300 and a distal front surface 310. The plurality of nominal front surfaces in the plurality of side members may be co-planar. Tight tolerances may be obtained, by example, by machining the ESBA after assembly thereof.

A frictional feature 320 may extend forwardly in the depth-wise direction D from one of: (i) the plurality of nominal front surfaces of the plurality of side members, and (ii) the first nominal front surface 240 of the center member 210. As used herein, a nominal surface means a planar surface depth-wise underneath a friction feature 320.

The plurality of nominal front surfaces of the respective plurality of side members may be coplanar with the first nominal front surface 240. In addition the plurality of side members and the center member 210 may have a same span in the height-wise direction H. Moreover, the plurality of side members and the center member 210 may be fixedly connected by at least one connector 330 extending in the widthwise direction through the ESBA. The at least one connector 330 may be a rivet.

The plurality of side members may have a respective plurality of rear portions. The plurality of rear portions may include a first rear portion 332 and a second rear portion 334. The plurality of rear portions may extend rearwardly in the depth-wise direction D beyond the center member 210. This configuration may provide an air gap between the center member 210 and one or more members behind the ESBA 200 that may contact the ESBA 200.

Figure 3:
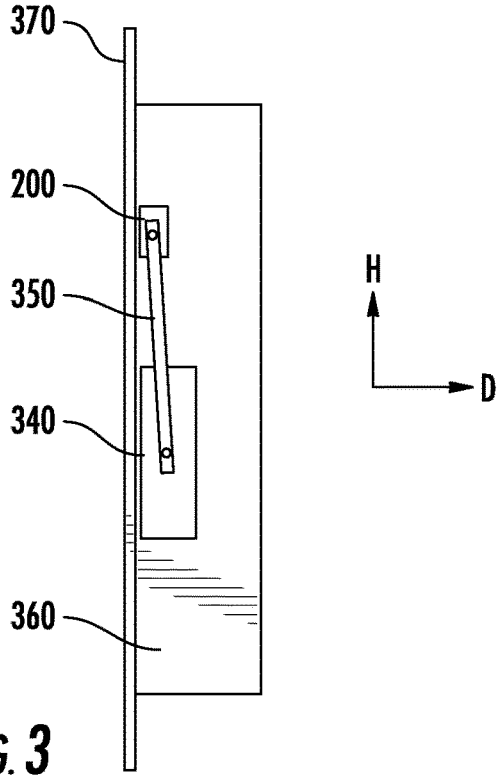
FIG. 3 illustrate an elevator with an ESBA according to a disclosed embodiment.

Turning to FIG. 3, the ESBA 200 may be connected to an electronic safety brake (ESB) 340 with a linkage 350, and the ESB 340 may be operationally connected to an elevator car 360. The friction feature 320 of the ESBA 200 may engage an elevator rail 370, thereby actuating the ESB 340 adjacent or against the elevator rail 370 to decelerate the elevator car 360.

Figure 4A:
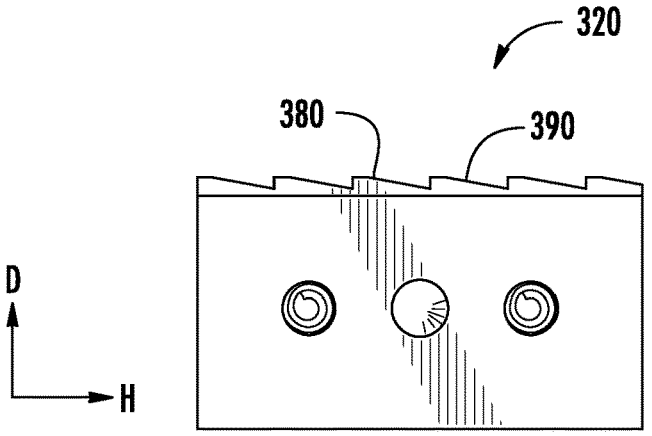
FIGS. 4A and 4B illustrate friction features of an ESBA according to a disclosed embodiment.
Figure 4B:
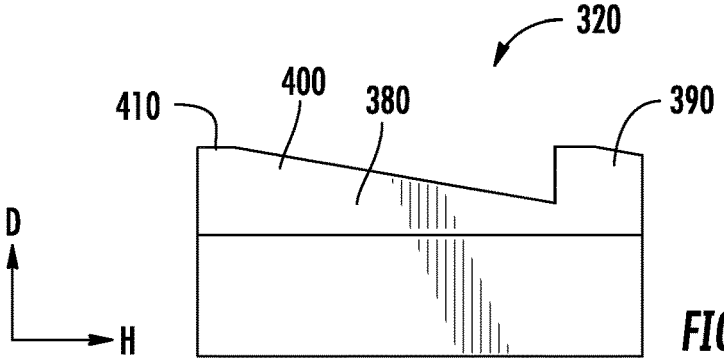

Turning to FIGS. 4A and 4B, in one embodiment the friction feature 320 may comprise a plurality of teeth. The plurality of teeth may include at least a first tooth 380 and a second tooth 390 which together form a saw-tooth profile. The saw-tooth profile may be aggressive to enable relatively rapid gripping of the ESBA 200 adjacent or against the elevator rail 370. The plurality of teeth may each include a cross-sectional profile formed by, for example, a right triangle 400 with a squared peak 410 in a height-wise bottom location.

Figure 5:
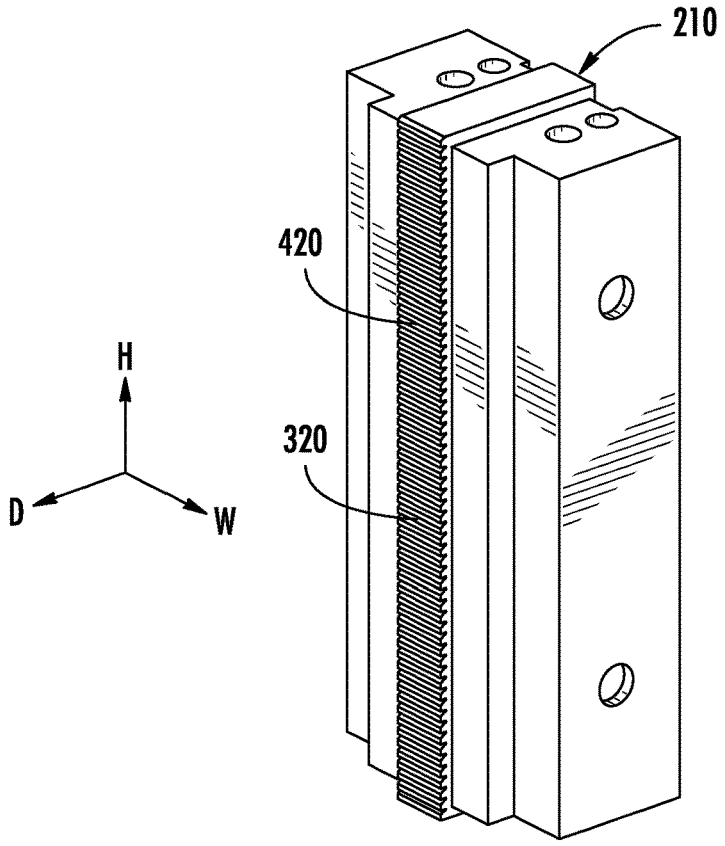
FIG. 5 illustrates an ESBA according to another disclosed embodiment.

Turning to FIG. 5, a cover plate 420 may be connected to the front surface of the center member 210. The cover plate 420 may have a same span in the width-wise direction D as the center member 210. The cover plate 420 may include the friction feature 320. According to an embodiment the cover plate 420 may be a metal or a non-metal, and it may also be magnetic or non-magnetic. For example the cover plate 420 may be extruded aluminum. A benefit of this embodiment may be an ease of replacement of the cover plate 420 due to a wearing away of the friction feature 320.

Figure 6A:
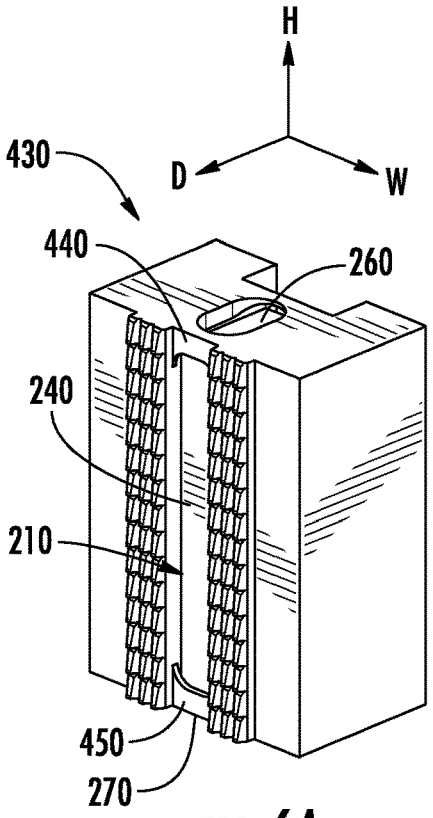
FIGS. 6A and 6B illustrates an ESBA according to another disclosed embodiment.
Figure 6B:
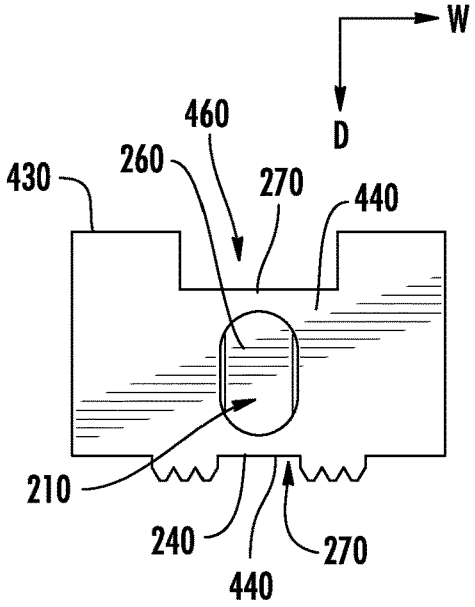

Turning to FIGS. 6A and 6B the plurality of side members may be width-wise integrally connected to form a unitary housing 430. A top portion 440 of the housing 430 may form a top bracket extending adjacent or against the first top surface 260 of the center member 210 and the first front surface 240 of the center member 210. A bottom portion 450 of the housing 430 may form a bottom bracket extending adjacent or against the first bottom surface 270 of the center member 210 and the front surface 240 of the center member 210. With this configuration the housing 430 may form a rear opening 460 through which the housing 430 may slidingly receive the center member 210. In an alternative embodiment the center member 210 may be inserted in into the housing 430 in different ways, for example but not limited to, from a top opening, a bottom opening, and a front opening. In an alternative embodiment a locking mechanism is provided to positional fix the center member 210 within the housing 430.

The above disclosure provides three solutions that may reduce a sensitivity of a magnet assembly to air-gaps in a magnetic circuit. By reducing the air gap sensitivity of the magnet assembly of the Electronic Safety Actuator (ESA) to air gaps, the component efficiency may increase to allow utilizing more of the available material to generate normal forces. Applicability of the embodiments disclosed herein utilized outside of elevator systems is within the scope of the disclosure.

A fourth solution disclosed above provides a modified tooth/friction interface that may provide a more aggressive profile. By providing a more aggressive profile, an average coefficient of friction may increase, which may reduce a sensitivity to generated normal forces. By modifying the friction interface to a more aggressive geometry, the overall component size may be reduced, reducing sensitivity to the normal force generated. It is to be appreciated that a configuration with a smooth surface profile for the front surface 240 of the center member 210 is within the scope of the disclosure.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. An electronic safety brake actuator (ESBA) for actuating an electronic brake, the ESBA comprising:

a first member having a proximate side and a distal side spaced in a widthwise direction, a first nominal front surface and a first rear surface spaced in a depth-wise direction, and a first top surface and a first bottom surface spaced in a height-wise direction;

a plurality of side members including a proximate member and a distal member, the proximate member disposed adjacent the proximate side of the first member and the distal member disposed adjacent the distal side of the first member, the first member being magnetic and the plurality of side members being at least partially non-magnetic, and the plurality of side members including a respective plurality of nominal front surfaces including a proximate front surface and a distal front surface, the plurality of nominal front surfaces being co-planar, wherein a friction feature extends forwardly in the depth-wise direction from the plurality of nominal front surfaces of the plurality of side members, and the friction feature comprises a plurality of teeth forming a saw-tooth profile defined by a cross-sectional profile that forms a right triangle with a peak, in operation, in a height-wise bottom location.

2. The ESBA of claim 1, wherein the plurality of side members extend rearwardly in the depth-wise direction beyond the first member.

3. The ESBA of claim 1, wherein the first member and the plurality of side members are metal.

4. The ESBA of claim 1, wherein the plurality of nominal front surfaces of the respective plurality of side members are co-planar with the first nominal front surface.

5. The ESBA of claim 1, wherein the plurality of side members and the first member have a same span in the height-wise direction.

6. The ESBA of claim 1, wherein the plurality of side members and the first member are fixedly connected by at least one connector extending in the widthwise direction through at least one of the plurality of side members and the first member.

* * * * *